US007122964B2

(12) United States Patent
Jung et al.

(10) Patent No.: US 7,122,964 B2
(45) Date of Patent: Oct. 17, 2006

(54) LAMP AND METHOD OF MANUFACTURING THE SAME

(75) Inventors: Jae-Ho Jung, Yongin-si (KR); Keun-Woo Lee, Suwon-si (KR); Jong-Dae Park, Seoul (KR); Hyeong-Suk Yoo, Seongnam-si (KR); Moon-Shik Kang, Seongnam-si (KR); Sang-Hyuck Youn, Seoul (KR); Kyu-Seok Kim, Yongin-si (KR); Jeong-Hwan Lee, Suwon-si (KR)

(73) Assignee: Samsung Electronics Co., Ltd., (KR)

( * ) Notice: Subject to any disclaimer, the term of this patent is extended or adjusted under 35 U.S.C. 154(b) by 114 days.

(21) Appl. No.: 10/495,293

(22) PCT Filed: Apr. 22, 2002

(86) PCT No.: PCT/KR02/00735

§ 371 (c)(1),
(2), (4) Date: May 12, 2004

(87) PCT Pub. No.: WO03/056883

PCT Pub. Date: Jul. 10, 2003

(65) Prior Publication Data

US 2004/0263042 A1 Dec. 30, 2004

(30) Foreign Application Priority Data

Dec. 29, 2001 (KR) ..... 2001/88037

(51) Int. Cl.
*H01J 11/00* (2006.01)
*H01J 65/00* (2006.01)

(52) U.S. Cl. ..... 313/607; 313/234; 427/430.1

(58) Field of Classification Search ..... 313/607, 313/234, 594; 445/22, 26–27, 14; 427/67, 427/430.1, 443.2
See application file for complete search history.

(56) References Cited

U.S. PATENT DOCUMENTS 6,515,433 B1 * 2/2003 Ge et al. ..... 315/227 R

FOREIGN PATENT DOCUMENTS

JP 10-134773 5/1998

(Continued)

OTHER PUBLICATIONS

PCT International Search Report; International application No. PCT/KR02/00735; International filing date: Apr. 22, 2002; Date of Mailing: Oct. 15, 2002.

(Continued)

*Primary Examiner*—Joseph Williams
*Assistant Examiner*—Bumsuk Won
(74) *Attorney, Agent, or Firm*—Cantor Colburn LLP

(57) ABSTRACT

In a lamp and method for fabricating the same, an outer surface of the lamp tube is dipped into a conductive transparent solution for forming an electrode by a predetermined depth, and then the lamp tube is pulled out from the solution. Accordingly, an electrode having different profiles is formed on the outer surface of the tube body. Also, the outer surface of the lamp tube is dipped into the solution by an acute angle, and is pulled out from the solution. Therefore, a problem of a nonuniform brightness between lamps is not generated, and light utilization efficiency is much enhanced even when using a plurality of lamp in parallel connected to a power supply.

16 Claims, 21 Drawing Sheets

FOREIGN PATENT DOCUMENTS

| | | |
|---|---|---|
| WO | WO 01/79922 A1 | 10/2001 |
| JP | 11-40109 | 2/1999 |
| JP | 2000-100389 | 4/2000 |

OTHER PUBLICATIONS

PCT International Preliminary Examination Report International Application No. PCT/KR2002/000735; International Filing date Apr. 22, 2002; Date of completion Oct. 18, 2004.

* cited by examiner (c)

LAMP AND METHOD OF MANUFACTURING THE SAME

TECHNICAL FIELD

The present invention relates to a lamp and method of manufacturing the same, and more particularly to a lamp and method of manufacturing the same for minimizing the luminance difference when the lamps, which are in parallel connected to a power supply, are turned on, as well as for maximizing the utilization efficiency of a light by extending an effective light-emitting region.

BACKGROUND ART

Generally, a lamp is a device for converting an electric energy into a light for objects to be recognized by workers' eyes at a dark place.

A lamp of cold cathode fluorescent tube (CCFT) is one of illumination devices for generating lights by utilizing an electric discharge phenomenon, i.e. electrons spatial movement.

These CCFT type lamps have advantages of being able to generate a white light similar to sun light, have a longer lifetime and generate less heat than fluorescent lamps and electric lamps.

This CCFT type lamp 10, as shown in FIG. 1, has a lamp tube 1 for providing a sealed discharging space, a first electrode 3 and a second electrode 5 for generating an electric discharge in the lamp tube 1.

Specifically, the lamp tube 1 has a tube body 1*a*, a fluorescent layer (not shown), and an operation gas 1*b*. More specifically, the lamp tube 1 has a closed shape sealed at both ends of the lamp tube 1. A predetermined thick fluorescent layer is formed by coating fluorescent material on inner surface of the tube body 1*a*, and the operation gas 1*b* is injected into the tube body 1*a*.

On the other hand, the first electrode 3 and the second electrode 5 are formed at an inner discharging space in the lamp tube 1. The first electrode 3 and the second electrode 5 are respectively formed at one end portion and the other end portion of the tube body 1*a* centering about the center of the tube body 1*a*. An electric power is applied to a pair of first and second electrodes 3 and 5 formed in the tube body 1*a*. The electric power has enough power, for example, for electrons to move from the first electrode 3 to the second electrode 5.

A light generating process begins by applying an electric power to the first electrode 3 and the second electrode 5.

Accordingly, electrons spatial movements are generated from the first electrode 3 to the opposite second electrode 5. Electrons move from the first electrode 3 to the second electrode 5, and collide with the operation gas 1*b*. Therefore, the operation gas 1*b* is decomposed into atoms, neutrons, and electrons. This means that plasma is formed in the tube body 1*a* by electrons spatial movement.

An invisible light is generated during this process in the tube body 1*a*, and the invisible light stimulates the fluorescent layer (not shown). Accordingly, a white light having a wavelength of visible ray, which is recognized by eyes of workers, is generated in the fluorescent layer.

However, the lamp 10, which includes the first electrode 3 and the second electrode 5 therein, has also fatal disadvantages although the lamp has various advantages. One of the fatal disadvantages is that a luminance difference is generated between lamps 10 when a plurality of lamps 10 in parallel connected with a power supply (not shown) is driven.

On the other hand, recently, a method for forming external electrodes made of metal on the outer surface of the lamp in order to solve the problem of the luminance difference. By using the plurality of lamps manufactured by this method, the luminance difference between the lamps may be minimized when the plurality of lamps in parallel connected with a power supply is driven, Although this method is able to solve the problem of the luminance difference, and is able to reduce the power consumption, this method causes another problem of reducing the utilization efficiency of a light because the external electrodes mask most of effective light-emitting region through which the generated light is transmitted.

DISCLOSURE OF THE INVENTION

The present invention has been made to solve the above problems of prior arts, therefore, it is the first object of the present invention to provide a lamp for maximizing an effective light-emitting region to greatly enhance a utilization efficiency of a light, as well as for minimizing the luminance difference even when the lamps in parallel connected with a power supply is turned on.

To achieve the first object of the invention, there is provided a lamp comprising a lamp tube, a first electrode and a second electrode. The lamp tube for generating a light has a first region and a second region separated from the first region, and includes an operation gas and a fluorescent material therein. The first electrode is formed at the first region of the lamp tube. The second electrode surrounds the circumference of the second region of the lamp tube, is extended toward a center of the lamp tube, is formed thinner according as the second electrode is formed at closer to the center of the lamp tube, and is separated from the first electrode.

The second object of the present invention is to provide a lamp manufacturing method for maximizing a utilization efficiency of a light, as well as for minimizing the luminance difference even when lamps parallel connected with a power supply is turn on.

To achieve the second object of the invention, there is provided a method for manufacturing a lamp, the lamp generating a light by an electrical power to a first region and a second region separated from the first region of a lamp tube. In the above method, a first electrode is formed at the first region of the lamp tube and then the lamp tube is transferred for the second region to be dipped in a solution for forming an electrode. A second electrode, which is coated thicker in proportion to a period during which the second region is dipped in the solution for forming an electrode, is formed by pulling out the second region toward the surface of the solution with a gradually decreasing speed.

According to the present invention, the lamp manufacturing method improves the conventional electrode forming method, maximizing a utilization efficiency of a light, as well as for solving the problem of the luminance difference even when the lamps in parallel connected with a power supply are turned on.

BRIEF DESCRIPTION OF DRAWINGS

The above objects and other advantages of the present invention will become more apparent by describing in detail preferred embodiments thereof with reference to the attached drawings in which.

BEST MODE FOR CARRYING OUT THE INVENTION

Hereinafter, a lamp and method for manufacturing the lamp according to the preferred embodiment of the present invention will be described in detail.

EMBODIMENT 1

Figure 1:
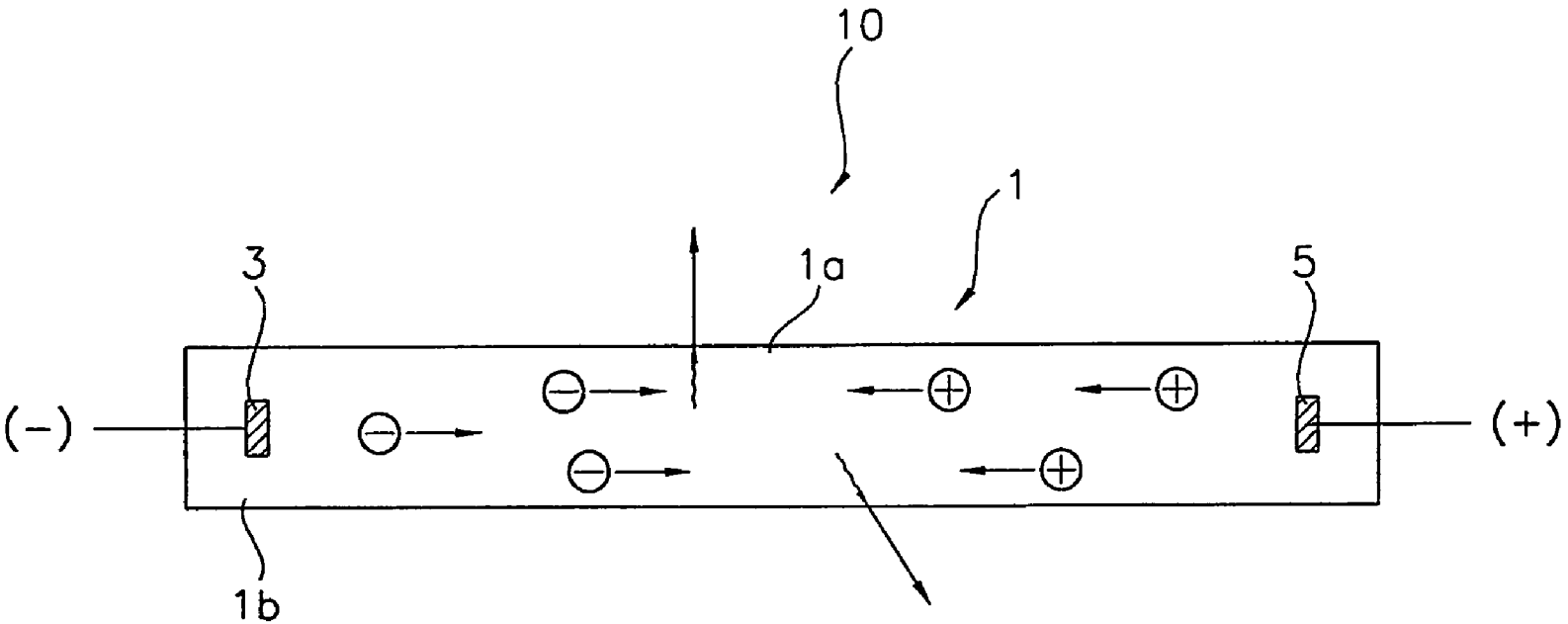
FIG. 1 (PRIOR ART)
FIG. 1 is a conceptual scheme of conventional lamp schematic view of a conventional liquid crystal display device.
Figure 2A:
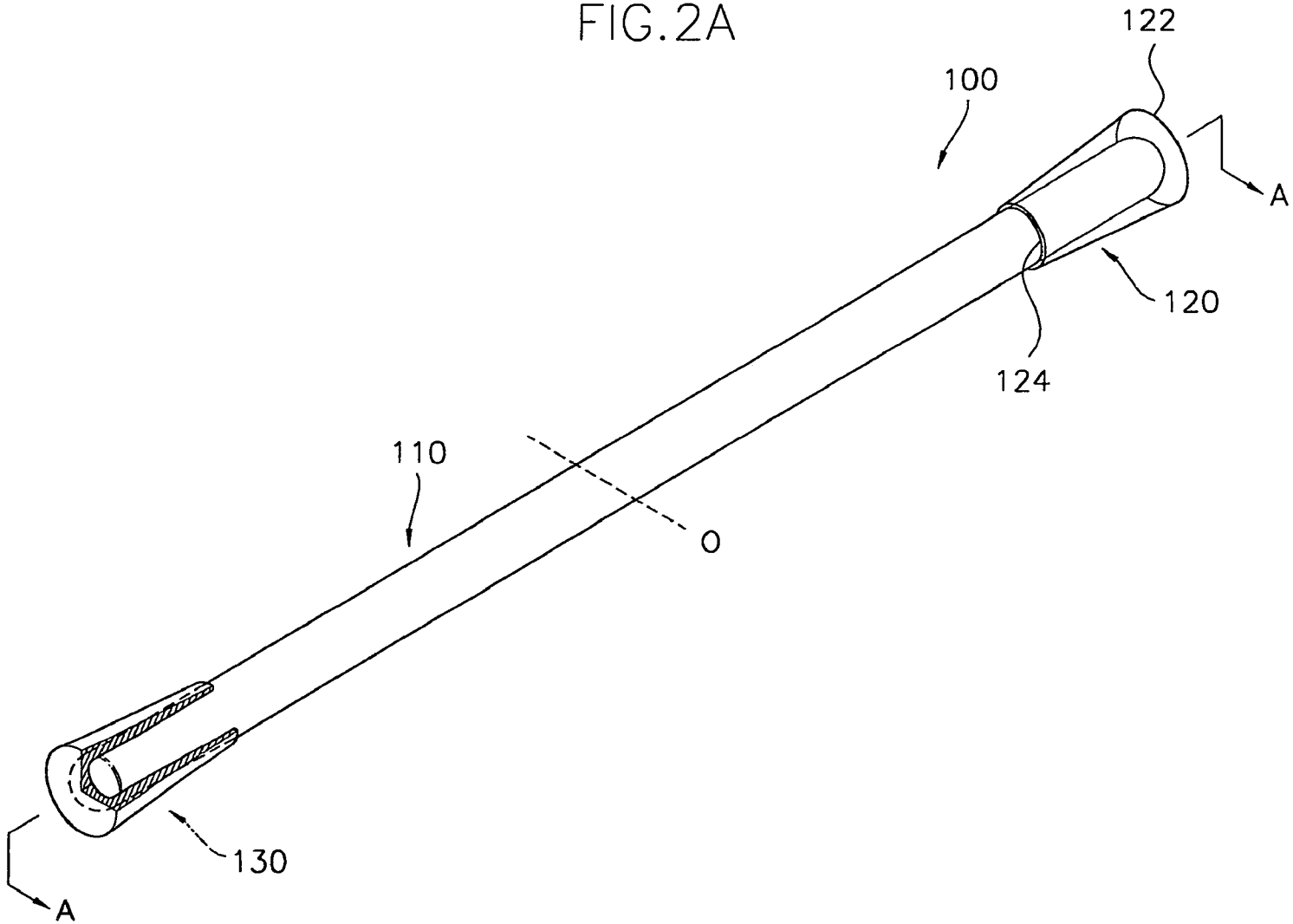
FIG. 2A is a partial cross-sectional perspective view showing a lamp according to a first embodiment of the present invention.
Figure 2B:
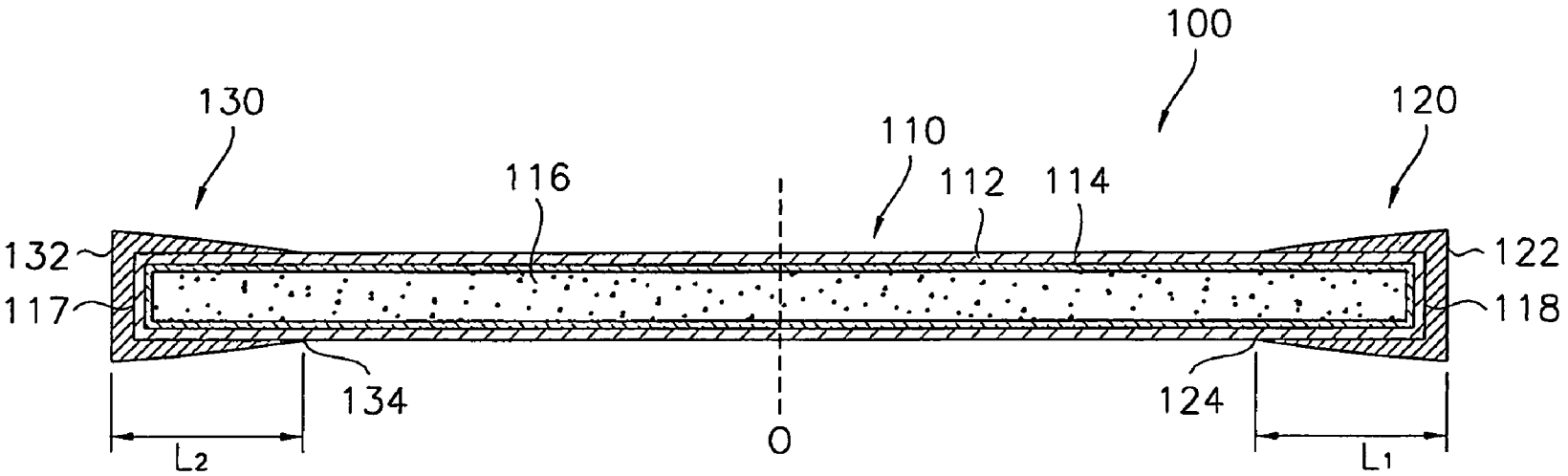
FIG. 2B is a cross-sectional view taken along the line A—A of FIG. 2.

FIGS. 2A and FIG. 2B show a lamp according to a first embodiment of the present invention. The lamp is a lamp of cold cathode fluorescent tube (CCFT) as a preferred embodiment of the present invention.

Referring to FIG. 2A and FIG. 2B, the lamp 100, according to one embodiment of the present invention, comprises a lamp tube 110, a first electrode 130, and a second electrode 120 as a whole.

Referring to FIG. 2B, the lamp tube 110 comprises a tube body 112, a fluorescent layer 114, and an operation gas 116. The tube body 112 has a transparent tube shape through which light passes.

The fluorescent material is coated by a predetermined thickness on the inner surface of the tube body 112, accordingly the fluorescent layer is formed thereon. On the other hand, the operation gas 116 is injected into the tube body 112 formed with the fluorescent layer on the inner surface thereof. A first end portion 117 and a second end portion 118 are sealed completely from the outside of the lamp tube 110.

Referring to FIGS. 2A and 2B, the first electrode 130 and the second electrode 120 according to the preferred embodiment of the present invention is formed at the tube body 112 of the lamp tube 110 having abovementioned construction.

The first electrode 130 and the second electrode 120 functions for supplying an electric power in order to generate an electric discharge in the lamp tube 110.

As one embodiment of the present invention, the first electrode 130 may be formed at either an inner surface portion or an outer surface portion of the lamp tube 110, and the second electrode 120 is formed at an outer surface portion of the lamp tube 110.

Referring to FIGS. 2A and FIG. 2B, both the first electrode 130 and the second electrode 120 are formed at outer surface portions of the lamp tube as a first embodiment of the present invention.

The first electrode 130 is comprised of a transparent conductive material, such as ITO or IZO as one embodiment of the present invention.

As a first embodiment of the present invention, the first electrode has a capping shape to surround the circumference surface of the tube body 110 at a first end portion 117 of the tube body 110. More specifically, the first electrode 130 surrounds the first end portion 117, and is extended by a length of a first region (L2) toward the central point (as shown "O" in FIG. 2B) of the tube body 110. The first region (L2) varies appropriately considering an area of the first electrode 130.

A first end portion 132 of the electrode is defined as an end portion of the first electrode 130 near to the first end portion 117, and a second end portion 134 of the electrode is defined as an end portion of the first electrode 130 near to the central point of the tube body 110.

The thickness of the first electrode 130 becomes thinner according as the first electrode 130 is formed starting from the first end portion 132 of the electrode to the second end portion 134 of the electrode. Namely, the first electrode 130 is the thickest at the first end portion 132 of the electrode. This has an object for reducing the light loss generated from the light, which is generated from the lamp tube 110, passing through the first electrode 130.

More specifically, the thickness of the first electrode 130 is thinnest at the second end potion 134 of the electrode, and the thickness of the second end portion 134 of the electrode is preferably in a range of 10–40 Å.

The second electrode 120 is also required in order to apply a discharging power to the lamp tube 110. As one preferred embodiment of the present invention, the second electrode 120 is formed on an outer surface portion as shown in FIGS. 2A and 2B.

More specifically, the second electrode 120 is comprised of a transparent conductive material, such as ITO or IZO as one embodiment of the present invention. The second electrode has a capping shape to surround the circumference surface of the tube body 110 at a second end portion 118 of the tube body 110 opposite to the first end portion 117. Also, the second electrode 120, which surrounds the tube body 110, is extended by a length of the second region (L1) that is the same as the first region (L2) toward the central point (as shown "O" in FIG. 2*b*) of the tube body 110. The second region (L1) is varied by appropriately considering an area of the second electrode 120.

A third end portion 122 of the electrode is defined as an end portion of the second electrode 120 near to the second end portion 118, and a fourth end portion 124 of the electrode is defined as an end portion of the second electrode 120 near to the central point of the tube body 110.

The thickness of the second electrode 120 becomes thinner according as the second electrode 120 is formed starting from the third end portion 122 of the electrode to the fourth end portion 124 of the electrode. That is, the second electrode 120 is the thickest at the third end portion 122 of the electrode. Thus, the light loss generated from the light passing through the second electrode 120 may be minimized.

Accordingly, the thickness of the second electrode 120 is thinnest at the fourth end potion 124 of the electrode, and the thickness of the fourth end portion 124 of the electrode is preferably a range of 10–40 Å.

FIGS. 3 and 4 show a method of manufacturing a lamp 100 as shown in FIGS. 2A and 2B.

Figure 3A:
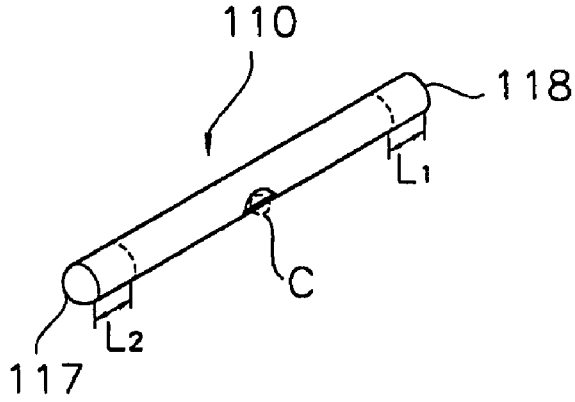
FIG. 3A is a perspective view showing a lamp tube according to the first embodiment of the present invention.
Figure 3B:
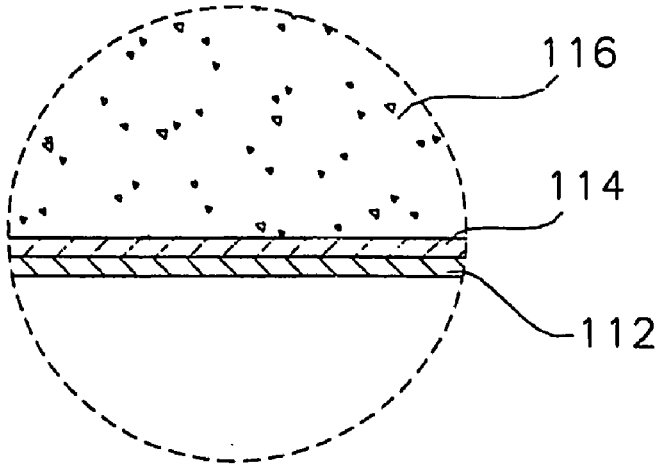
FIG. 3B is a partially magnified view of a portion C of the lamp tube in FIG. 3A.
Figure 3C:
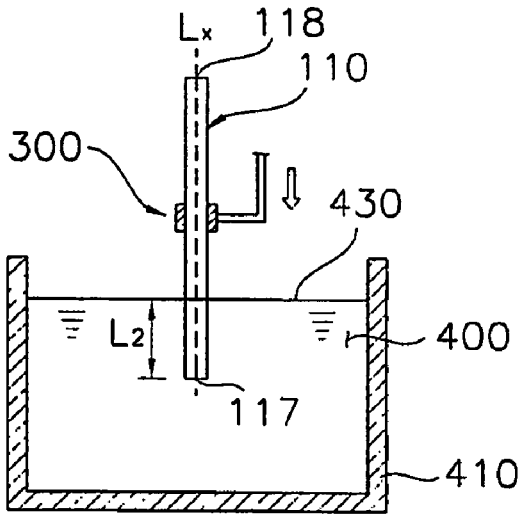
FIGS. 3C–3E are schematic views showing a method for manufacturing a lamp having a first electrode according to the first embodiment of the present invention.

Referring to FIG. 3A and FIG. 3B, the lamp tube 110, into which a fluorescent layer 114 and an operation gas 116 are injected, is gripped tightly by means of a transfer device 300 as shown in FIG. 3C. The lamp tube 110 is transferred as shown in FIG. 3C, the first region (L2) of the lamp tube 110 is dipped into a transparent liquid solution 400 for forming an electrode. The reference numeral 410 represents a container for receiving the solution 400 for forming an electrode.

The lamp tube 110 is coated with the solution 400 for forming an electrode according as the lamp tube 110 is dipped into the solution 400 for forming an electrode. Hereinafter, the solution 400 coated on the lamp tube 110 is defined as the first electrode 130.

The surface 430 of the solution 400 for forming an electrode is perpendicular to the longitudinal axis (Lx) of the lamp tube 110 as one preferred embodiment of the present invention.

Figure 3D:
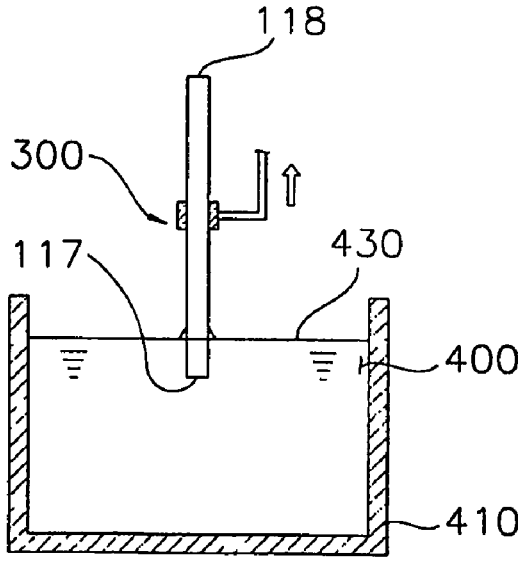

The transfer device 300, which fixes the lamp tube 110 as shown in FIG. 3D, moves to the direction in which the lamp tube 110 is pulled out from the solution 400 for forming an electrode. The pulling out speed, with which the lamp tube 110 is pulled out from the solution 400 for forming an electrode, is very important.

More specifically, a profile of the first electrode 130 is formed differently according to the pulling out speed until the first end portion 117 of the lamp tube 110, which is dipped in the solution 400 for forming an electrode, is pulled out of the solution 400 for forming an electrode.

Figure 3E:
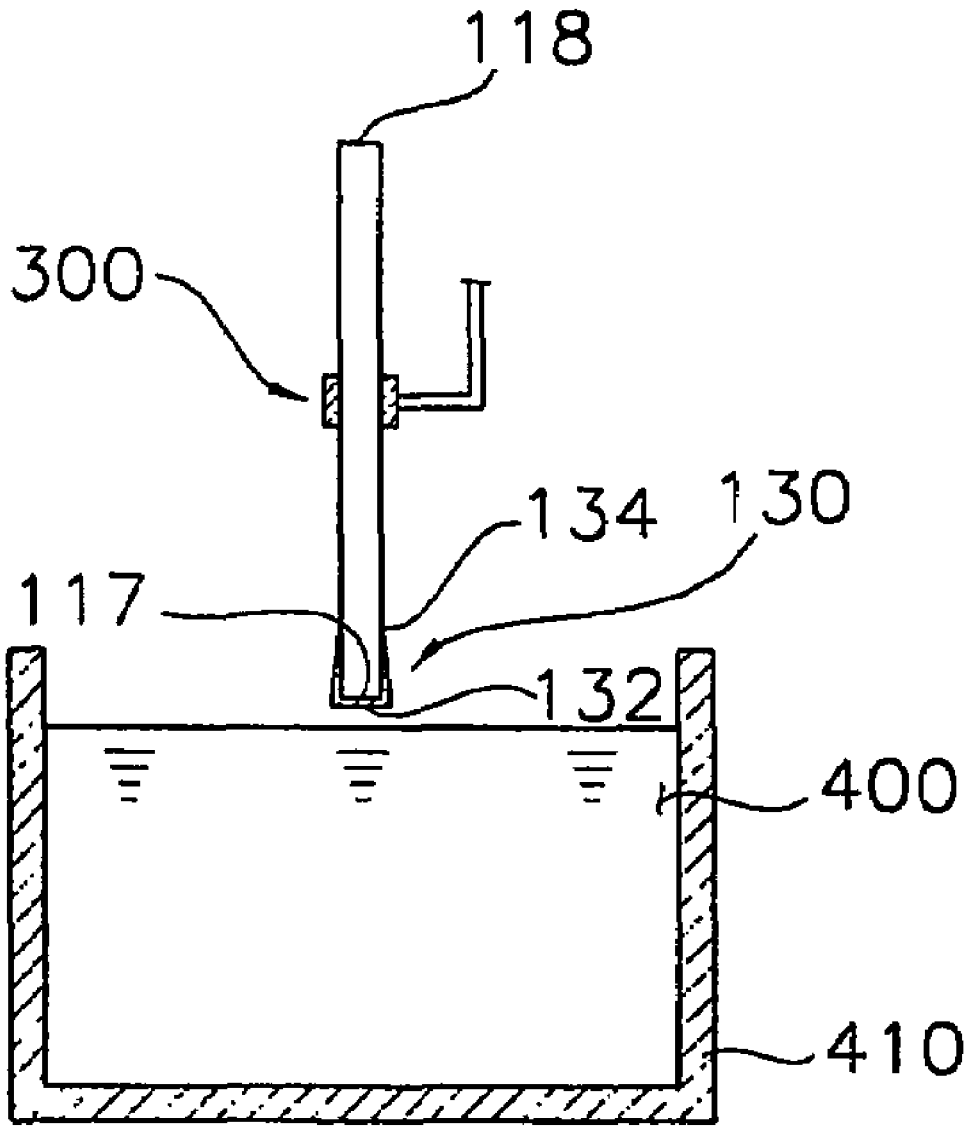

The lamp tube 110 is pulled out by a predetermined speed at first, and is pulled out by gradually decreasing the speed as one preferred embodiment of the present invention. As shown in FIG. 3E and FIG. 2B, the first electrode 130 has such a profile that the thickness of the first electrode 130 becomes thinner according as the first electrode 130 is formed from the first end portion 132 of the electrode to the second end portion 134 of the electrode, because the thickness increases in proportion to the period while the lamp tube 110 is dipped in the solution 400 for forming an electrode.

Figure 4A:
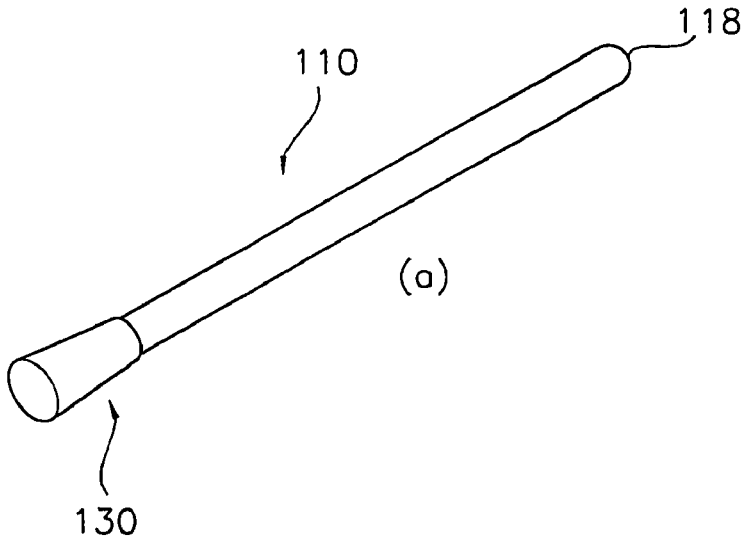
FIG. 4A is a perspective view showing a lamp tube having a first electrode according to the first embodiment of the present invention.

After the first electrode 130 is formed on the lamp tube as shown in FIG. 4A, the second end portion 118 is disposed in parallel with the surface of the solution 400 for forming an electrode. It is preferable that the surface of the solution 400 for forming an electrode is perpendicular to the longitudinal axis of the lamp tube 110.

Figure 4B:
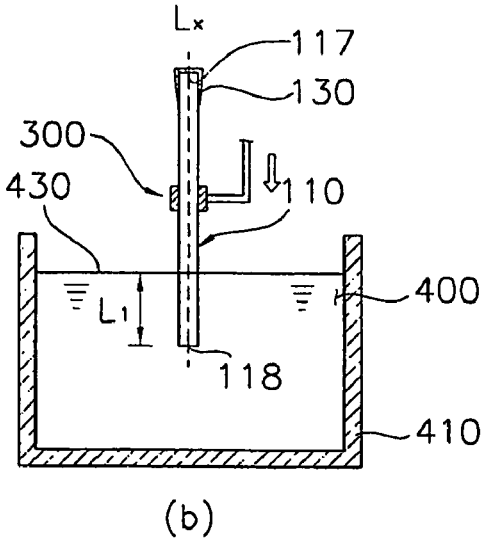
FIGS. 4B–4D are schematic views showing a method for manufacturing a lamp having a second electrode after forming a first electrode according to the first embodiment of the present invention.

Thereafter, the lamp tube 110 is dipped into the solution 400 for forming an electrode by a depth of the second region (L1) as shown in FIG. 4B.

The lamp tube 110 is coated with the solution 400 according as the lamp tube is dipped in the solution 400. Hereinafter, the second electrode 120 is defined as the solution 400 coated on the lamp tube 110.

Figure 4C:
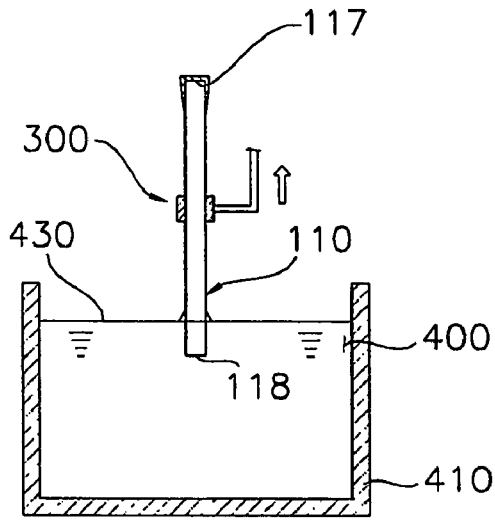
Figure 4D:
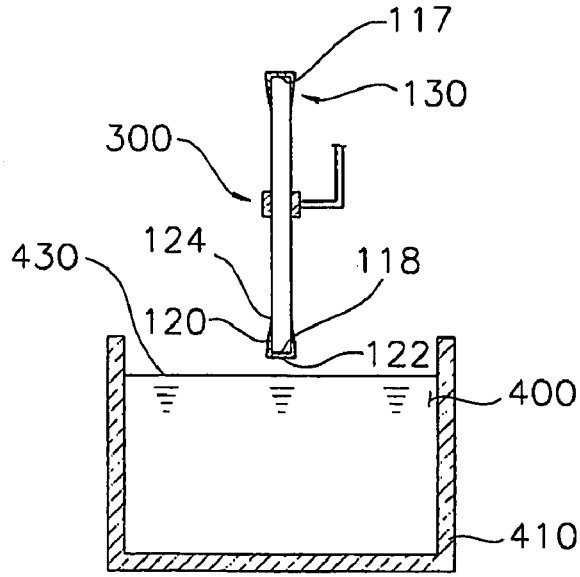

The transfer device 300, which fixes the lamp tube 110 as shown in FIG. 4C, moves to the direction in which the lamp tube 110 is pulled out from the solution 400 for forming an electrode. The pulling out speed, with which the lamp tube 110 is pulled out from the solution 400 for forming an electrode, is very important. More specifically, the lamp tube 110 is pulled out form the solution 400 for forming an electrode by a predetermined speed at first, and is pulled out by gradually decreasing the speed. As shown in FIG. 4D, the second electrode 120 has such a profile that the thickness of the second electrode 120 becomes thinner according as the second electrode 120 is formed from the third end portion 122 of the electrode to the fourth end portion 124 of the electrode.

EMBODIMENT 2

Figure 5A:
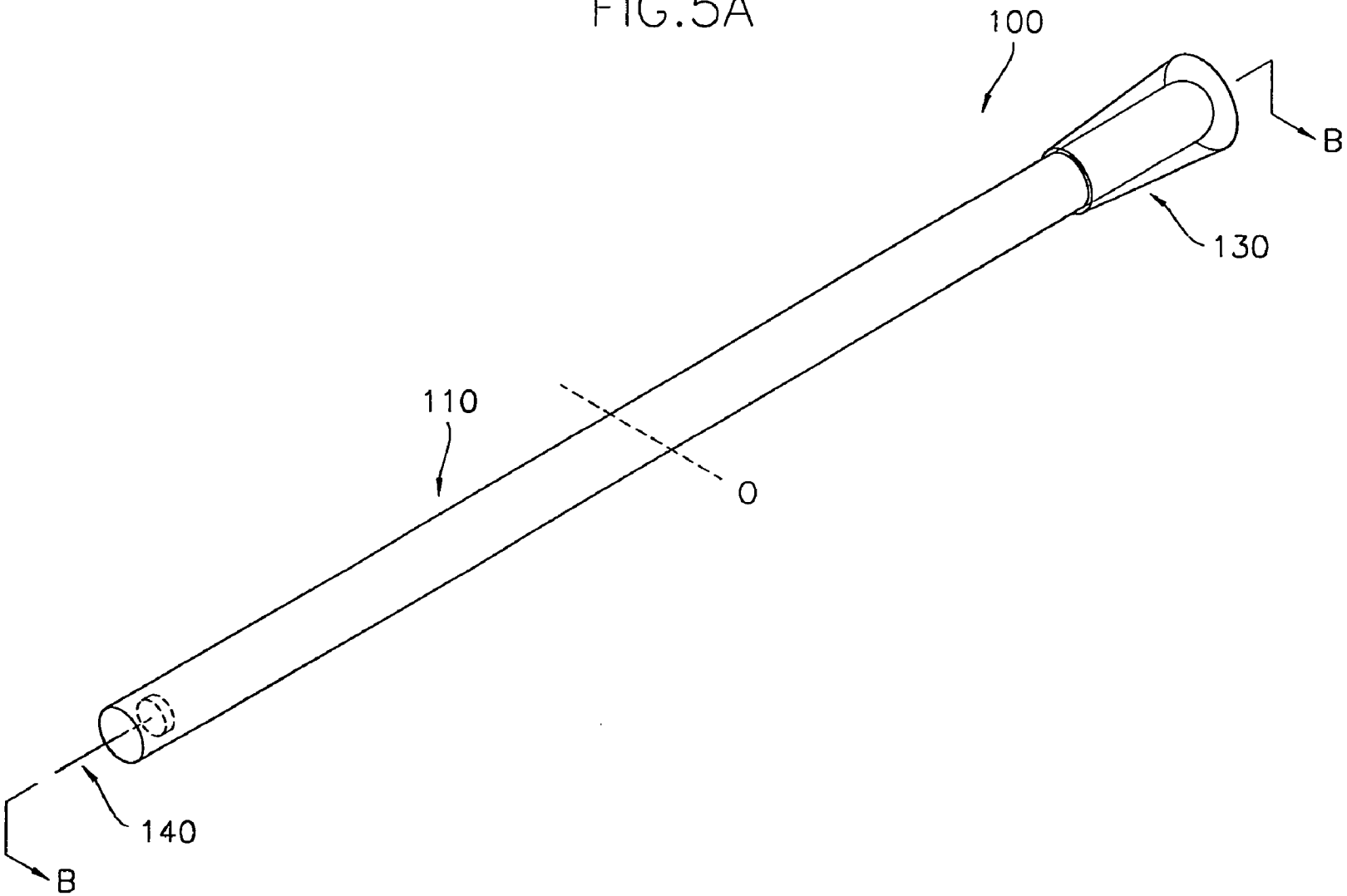
FIG. 5A is a perspective view showing the lamp according to a second embodiment of the present invention.
Figure 5B:
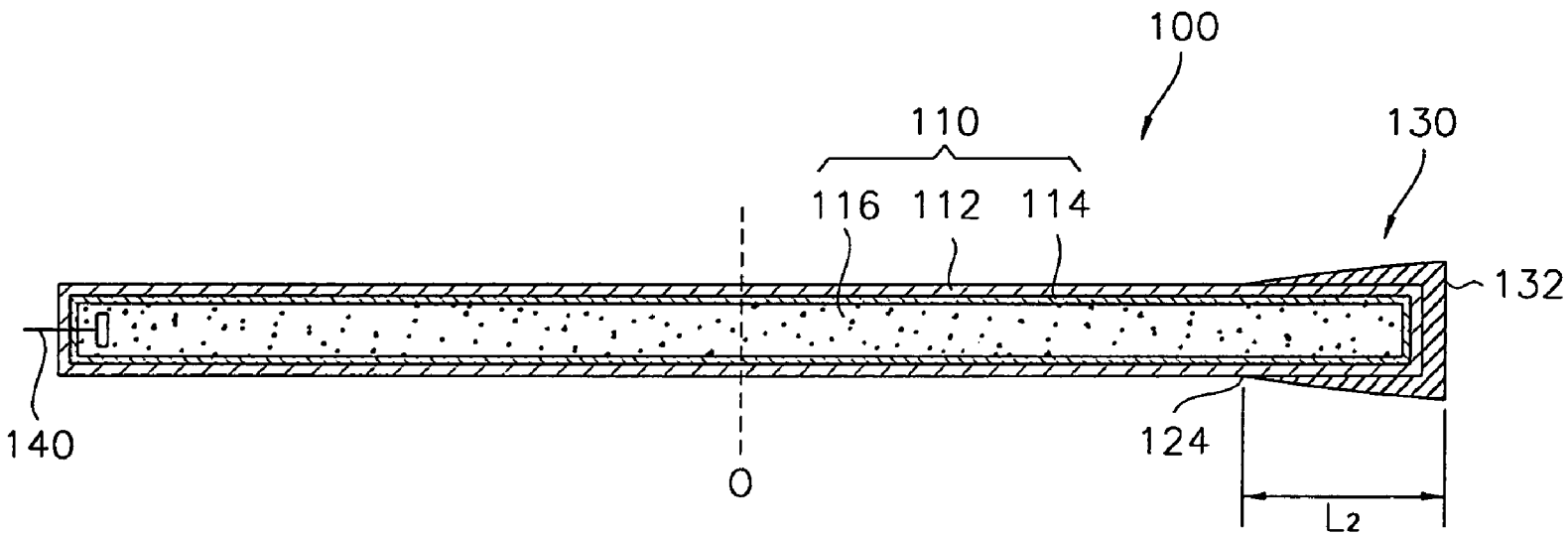
FIG. 5B is a cross-sectional view taken along the line B—B of FIG. 5A.

Another embodiment different from the first embodiment is shown in FIG. 5A and FIG. 5B. Referring to FIG. 5A or FIG. 5B, the first electrode 140 is disposed at inner surface of the lamp tube 110, and the second electrode 130 can be formed at outer surface of the lamp tube 110 as in Embodiment 2.

When the first electrode 140 is disposed at an inner surface of the tube body 110, it has another advantage that it is able to improve light utilization efficiency and power consumption in the lamp tube 110.

FIGS. 6A–6D show a method for manufacturing a lamp as shown in FIG. 5A or FIG. 5B.

Figure 6A:
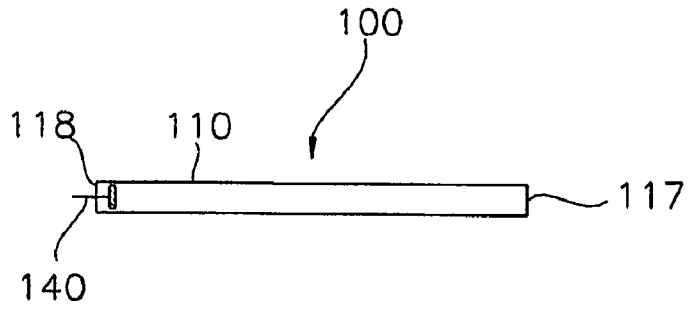
FIG. 6A is a perspective view showing a lamp tube having a first electrode according to the second embodiment of the present invention.

At first, the first electrode 140 is formed at the first end portion 118 during the process where the fluorescent layer and the operation gas is injected into the inside of the lamp tube 110 when manufacturing the lamp tube shown in FIG. 6A. Namely, the first electrode 140 is an inner electrode disposed in the tube body 112.

Figure 6B:
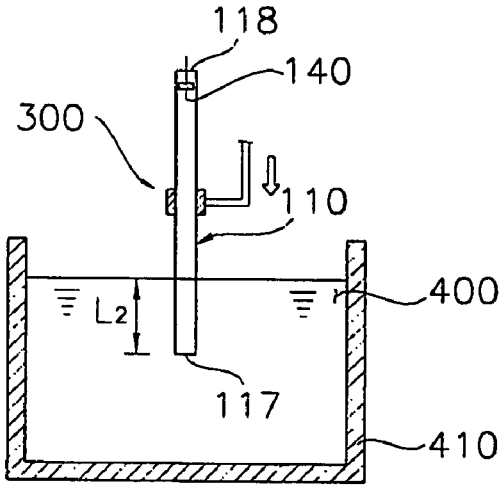
FIGS. 6B–6D are schematic views showing a method for manufacturing a lamp having a second electrode after forming a first electrode according to the second embodiment of the present invention.
Figure 6C:
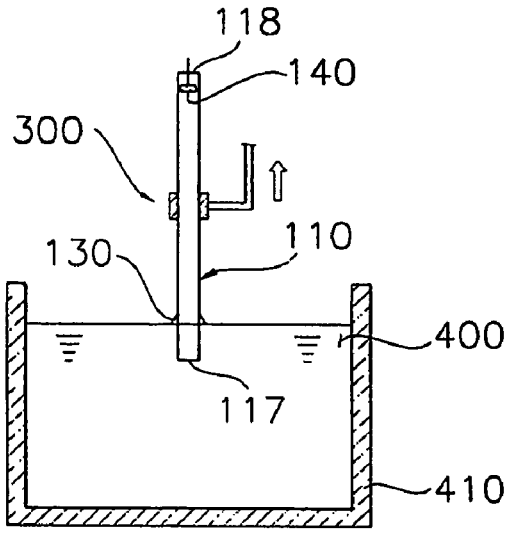

The lamp 100 is gripped tightly by means of the transfer device 300 as shown in FIG. 6B while the first electrode 140 being disposed in the tube body 110. Then, the second end portion 117 is disposed opposite to the transparent solution 400 for forming an electrode.

Then, the transfer device 300 for the lamp tube 110 transfer the lamp tube 110 to be dipped into the solution 400 by a predetermined depth such as the depth of the second region (L2).

Hereinafter, the second electrode 130 is defined as the solution 400 coated on the lamp tube 110.

Then, the transfer device 300 transfers the lamp tube 110 in the reverse direction to be pulled up from the solution 400.

Figure 6D:
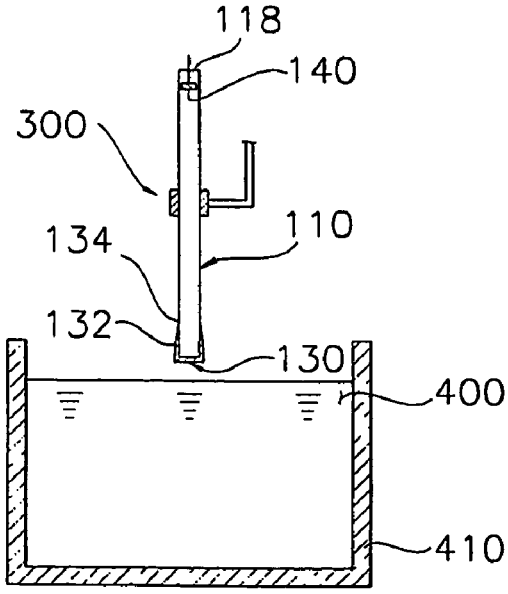

The thickness of the second end portion 134 of the electrode is made thinner than that of the first end portion 132 of the electrode by precisely controlling the pulling out speed of the lamp tube 110 from the solution 400 as shown in FIG. 6D.

In the previously embodiments with reference to FIGS. 4A–6D, there is disclosed an embodiment of enhancing an utilization efficiency for the light generated from the lamp tube 110 by controlling the profile of the first electrode 140 or the second electrode 130.

EMBODIMENT 3

Hereinafter, in another embodiment of the present invention, there is disclosed a lamp in which the electrode is not formed on the portion where the light is transmitted, and the electrode is extended at another portion where the light is not transmitted.

One embodiment of the lamp is illustrated as follows by referring to FIG. 7A and 7B.

Figure 7A:
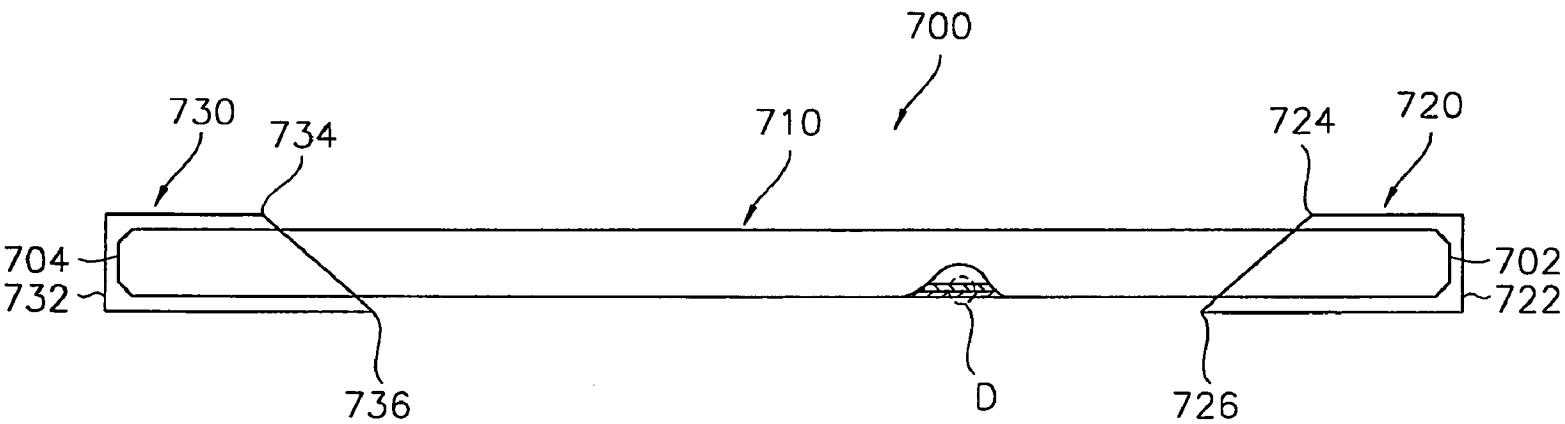
FIG. 7A is a partial cross-sectional perspective view showing a lamp according to a third embodiment of the present invention.
Figure 7B:
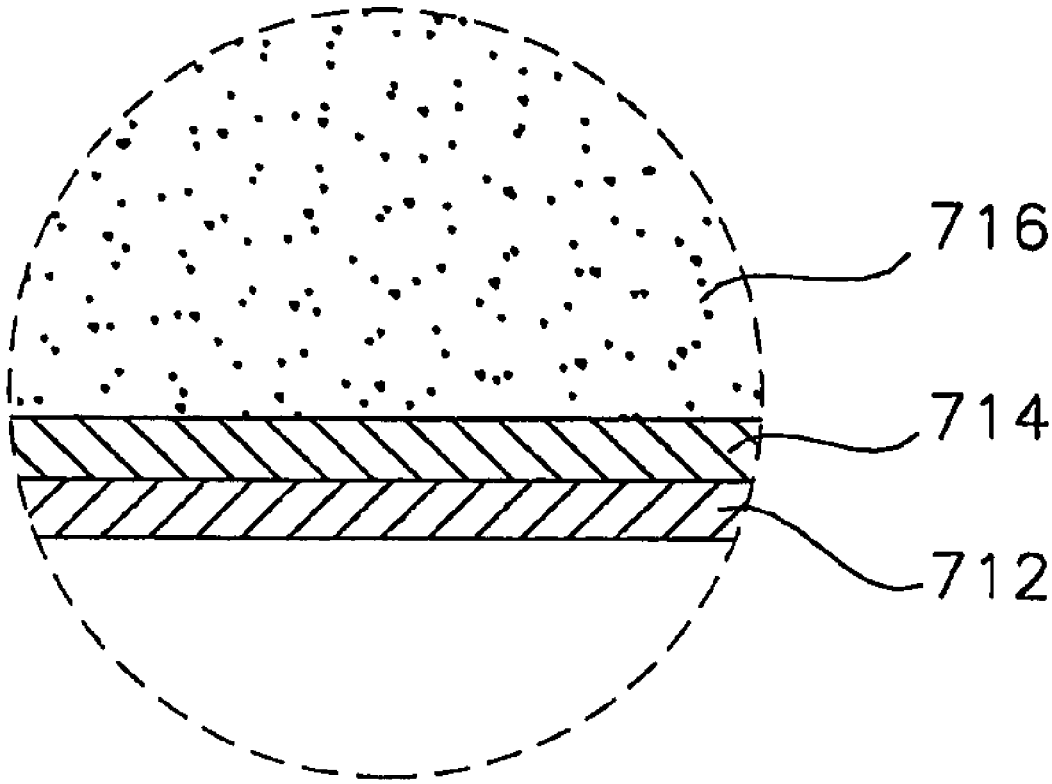
FIG. 7B is a partially magnified view of a portion D of the lamp tube in FIG. 7A.

First, referring to FIG. 7A and 7B, the lamp comprises a lamp tube 710, a fluorescent layer 714 formed by coating the fluorescent material on the inner surface of the tube body 712, and an operation gas formed at inner surface of the tube body 712.

A first electrode 730 and a second electrode 720 are formed at the outer surface of the lamp tube 710 having the abovementioned structure. The first electrode 730 and the second electrode 720 are produced by coating a conductive material, such as gold, silver, copper, ITO, and IZO etc., on the circumference surface of the lamp tube 710. An electroless plating method may be used for the metal materials, and a coating method may be used for the ITO and IZO that are in a liquid state.

The first electrode 730 surrounds the circumference surface of the lamp tube 710, and when each first points lies precisely on a straight line with each corresponding second points, a distance between each first points on a slanted end of the first electrode 730 and each corresponding second points on a first end portion 732 of the first electrode varies continuously. More specifically, the distance between each first points and each corresponding second points increases continuously according as the first point rotates along a circumference of the slanted end of the first electrode 730 from the point (this point is shown as reference numeral 734 in FIG. 7A) having the shortest distance, and is the longest at the 180° rotated point (this point is shown as reference numeral 736 in FIG. 7A) from the point 734. When each first points lies precisely on a straight line with each corresponding second points, the distance between each first points on a slanted end of the first electrode 730 and each corresponding second points on a first end portion 732 of the first electrode decreases continuously according as the first point rotates along the circumference of the slanted end of the first electrode 730 from the point 736, and is the shortest at the point 734.

On the other hand, the second electrode 720 has the same shape as the first electrode 730. The point 724, which has the shortest distance from the second end portion 722 of the second electrode 720, lies precisely in the straight line with the point 734 of the first electrode 730 on the circumference surface. Also, the point 726, which has the longest distance from the second end portion 722 of the second electrode 720, lies precisely on the straight line with the point 736 of the first electrode 730 on the circumference surface.

In the point 734 or 724, which has the shortest distance respectively from the first end portion 732 of the first electrode 730 or the second end portion 722 of the second electrode 720, the light utilization efficiency is maximized due to the abovementioned relationship between the first electrode 730 and the second electrode 720.

Hereinafter, a manufacturing method for a lamp 700 of FIG. 7A is illustrated with reference to FIG. 8A–8D.

Figure 8A:
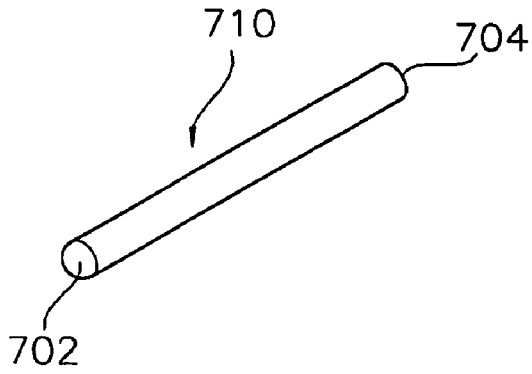
FIG. 8A is a perspective view showing a lamp tube according to the third embodiment of the present invention.
Figure 8B:
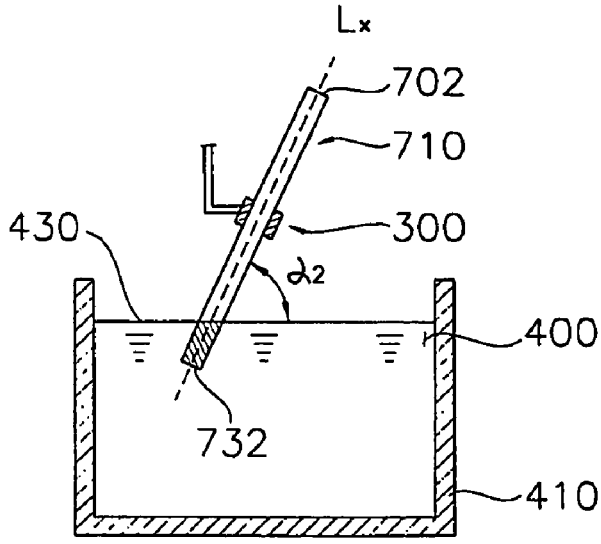
FIGS. 8B–8D are schematic views showing a method for manufacturing a lamp according to the third embodiment of the present invention.
Figure 8C:
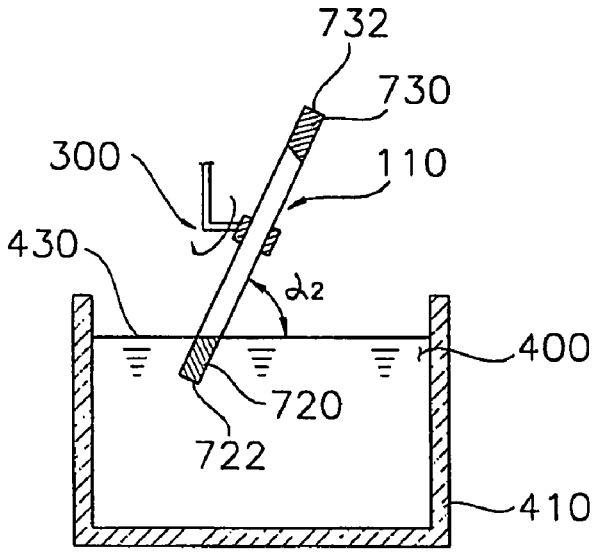
Figure 8D:
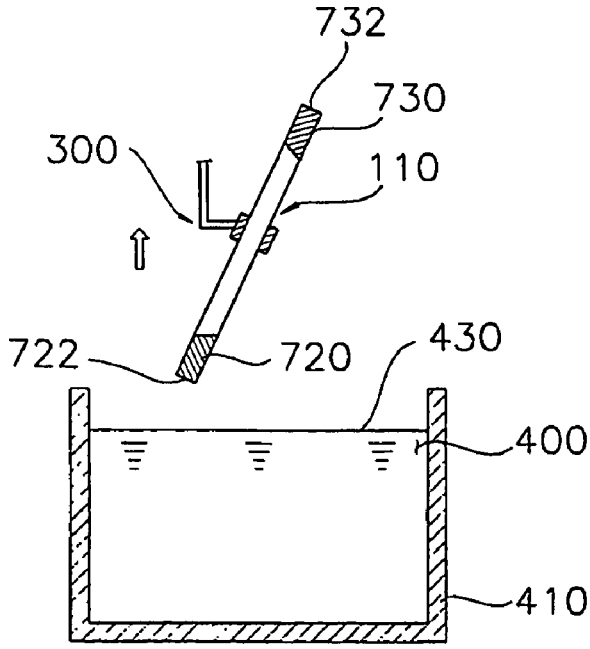

First, a method of manufacturing a lamp tube 710, in which the fluorescent layer and the operation gas is injected into the lamp tube 710, is performed as shown in FIG. 8B–8D. The lamp tube 710 is gripped tightly by means of the transfer device 300. Then, the first end portion 704 of the lamp tube 710, which is gripped tightly by the transfer device 300, is dipped into the conducting solution 400 for forming an electrode as shown in FIG. 8B.

The angle $\alpha 1$ between the longitudinal axis (Lx) of the lamp tube 710 and the surface of the solution 400 is very important when the lamp tube is dipped into the solution 400.

Specifically, the angle between the longitudinal axis (Lx) of the lamp tube 710 and the surface of the solution 400 is an acute angle.

Then, the lamp tube 710 is completely pulled out from the solution 400. Hereinafter, the first electrode 730 is defined as the solution 400 coated on the lamp tube 710.

The lamp tube 710 is rotated by the transfer device 300, and the second end portion 702 opposite to the first end portion 704 is disposed opposite to the surface of the solution 400 after the first electrode 730 is formed on the lamp tube 710.

The second end portion 702 of the lamp tube 710 is dipped into the solution 400 by a predetermined depth as shown in FIG. 5C. The angle $\alpha 2$ between the longitudinal axis (Lx) of the lamp tube 710 and the surface of the solution 400 is an acute angle. The angle $\alpha 2$ for forming the second electrode 720 is the same as the angle $\alpha 1$ for forming the first electrode 730.

The portion, which is dipped into the solution 400, is the second electrode 720 of the lamp tube 710. The shape of the second electrode 720 is a mirror shape of the previously defined first electrode 730 with respect to the center of the lamp tube 710.

Hereinafter, the lamp tube 710 is pulled out from the solution 400 by the lamp tube transfer device 300 as shown in FIG. 8D, and accordingly the lamp is manufactured.

EMBODIMENT 4

Figure 9A:
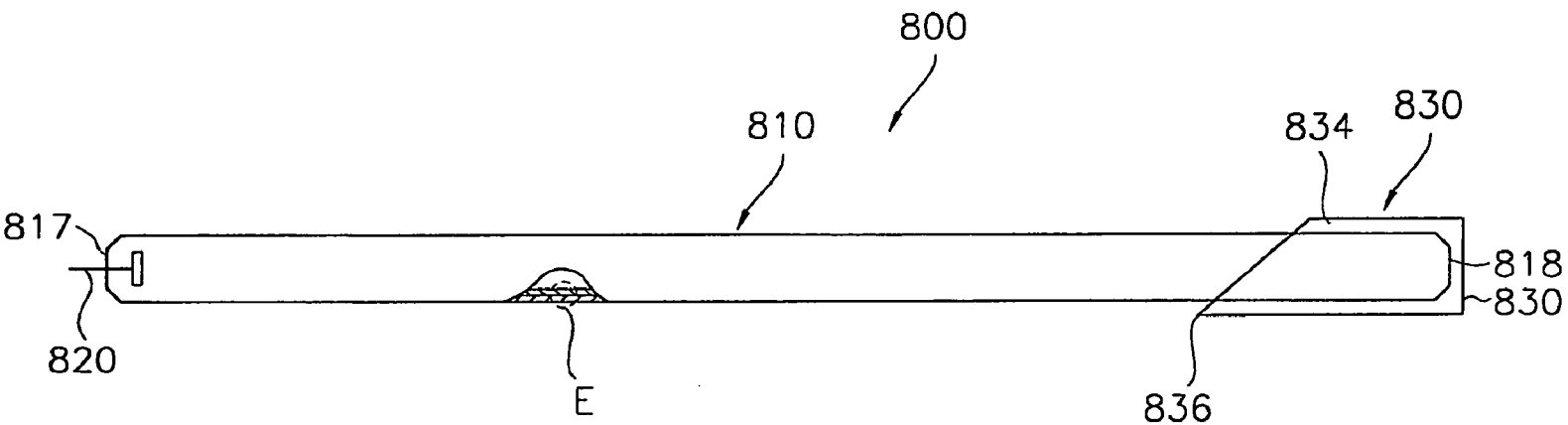
FIG. 9A is a perspective view showing a lamp tube according to the fourth embodiment of the present invention.
Figure 9B:
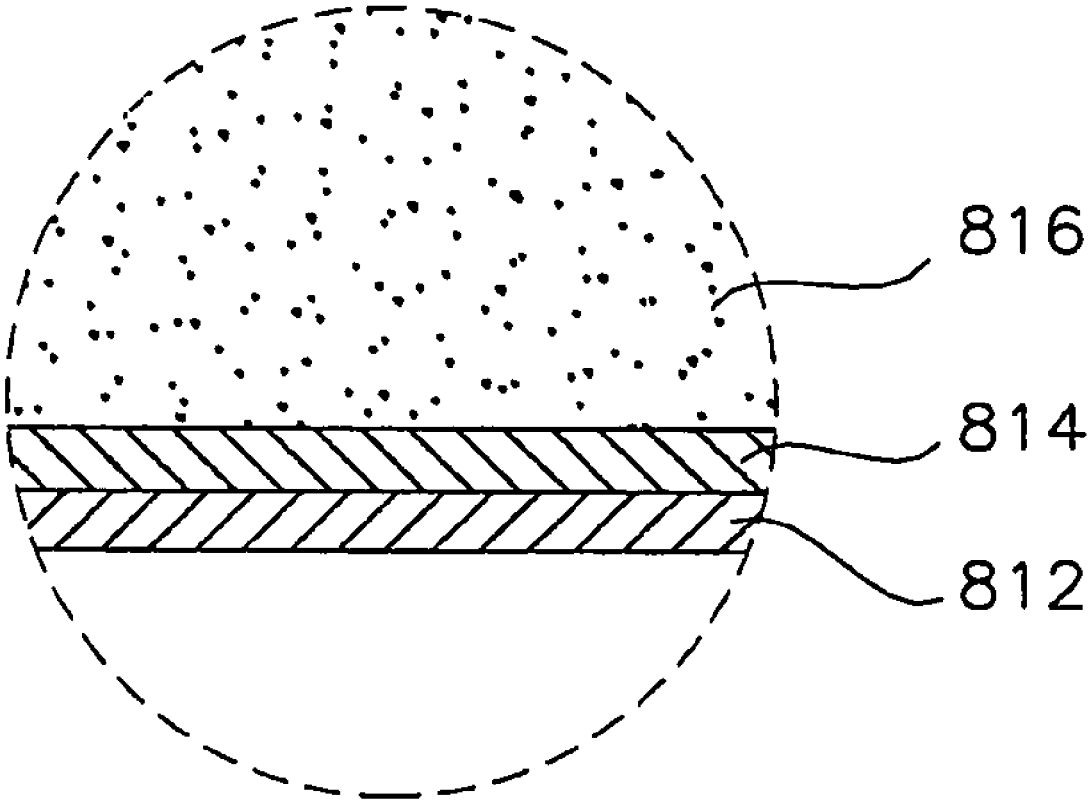
FIG. 9B is a partially magnified view of a portion E of the lamp tube in FIG. 9A.

Referring to FIGS. 9A and 9B, a first electrode 820 is formed at a first end portion 817 of a lamp tube 810 into which a fluorescent layer 814 and a operation gas 816, and the first electrode 820 is disposed in the lamp tube 810.

A second electrode 830 is formed along the circumference surface of the lamp tube 810 at a second end portion 818 opposite to the first end portion 817.

The second electrode 830 surrounds the circumference surface of the lamp tube 810, and when each fifth points lies precisely on a straight line with each corresponding sixth points, a distance between each fifth points on a slanted end of the second electrode 830 and each corresponding sixth points on a second end portion 832 of the second electrode 830 varies continuously. More specifically, the distance between each fifth points and each corresponding sixth points increases continuously according as the fifth point rotates along a circumference of the slanted end of the second electrode 830 from the point 834 having the shortest distance, and is the longest at the 180° rotated point 836 from the point 834. When each fifth points lies precisely on a straight line with each corresponding sixth points, the distance between each fifth points on a slanted end of the second electrode 830 and each corresponding sixth points on a second end portion 832 of the second electrode decreases continuously according as the fifth point rotates along the circumference of the slanted end of the second electrode 830 from the point 836, and is the shortest at the point 834.

Figure 10A:
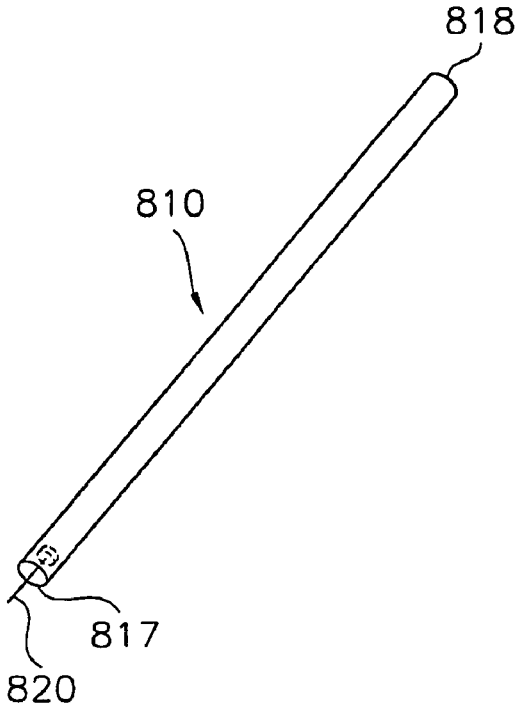
FIG. 10A is a perspective view showing a lamp tube having a first electrode according to the fourth embodiment of the present invention.
Figure 10B:
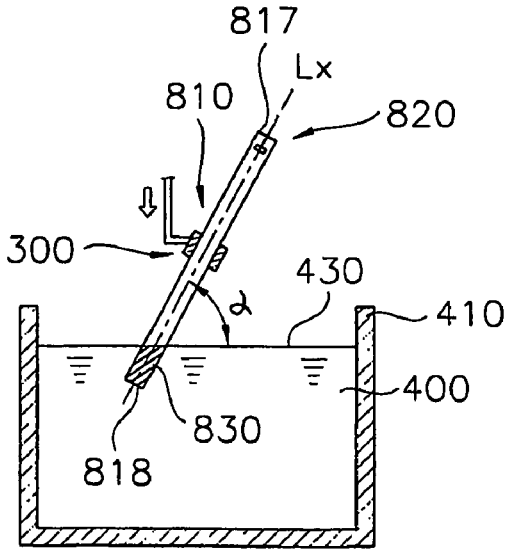
FIGS. 10B–10C are schematic views showing a method for manufacturing a lamp having a second electrode after forming a first electrode according to the fourth embodiment of the present invention.

Hereinafter, a method of manufacturing a lamp with the abovementioned structure is illustrated with reference to FIGS. 10A–10C.

First, the lamp tube 810, which is formed with the first electrode 820, is gripped tightly by means of the transfer device 300. Then, the second end portion 818, which is opposite to the first end portion 817, of the lamp tube 810 gripped tightly by the transfer device 300, is disposed opposite to the conducting solution 400 for forming an electrode.

The angle $\alpha$ between the longitudinal axis (Lx) of the lamp tube 810 and the surface of the solution 400 is an acute angle. Referring to FIG. 10B, the second end portion 818 of the lamp tube 810 is dipped into the solution 400 by a predetermined depth. The second electrode 830 is defined as the solution 400 coated on the lamp tube 810.

Figure 10C:
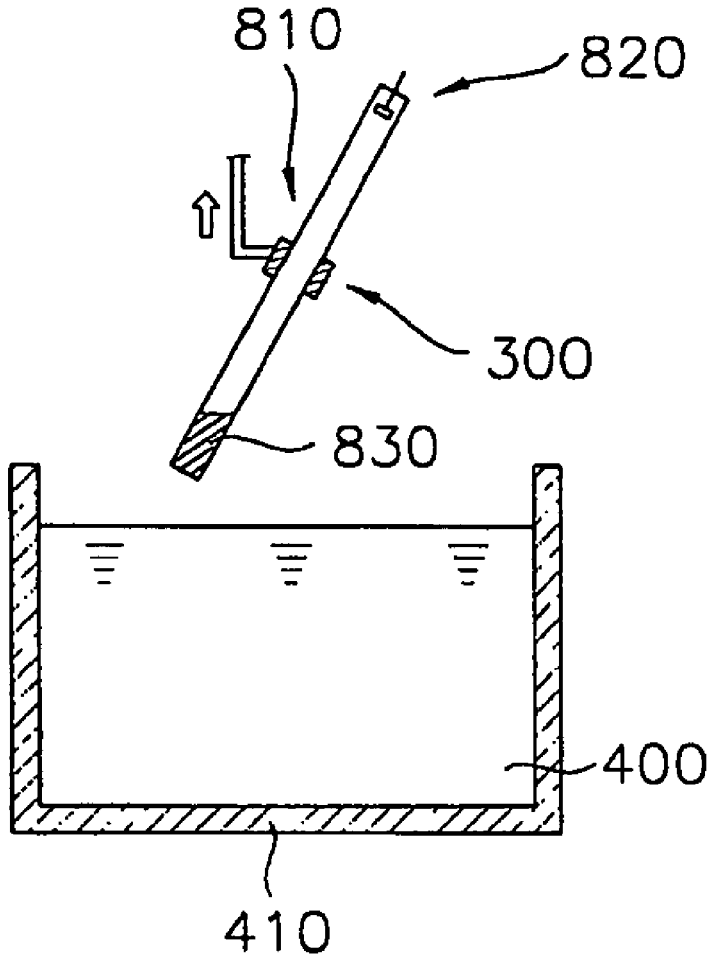

Then, the lamp tube 810 is pulled out from the solution 400 by the lamp tube transfer device 300 as shown FIG. 10C, and accordingly the lamp is manufactured.

On the other hand, the lamps shown in FIGS. 2A–10B according to various embodiment of the present invention, is able to be used in the liquid crystal display device as one embodiment of the present invention.

Figure 11:
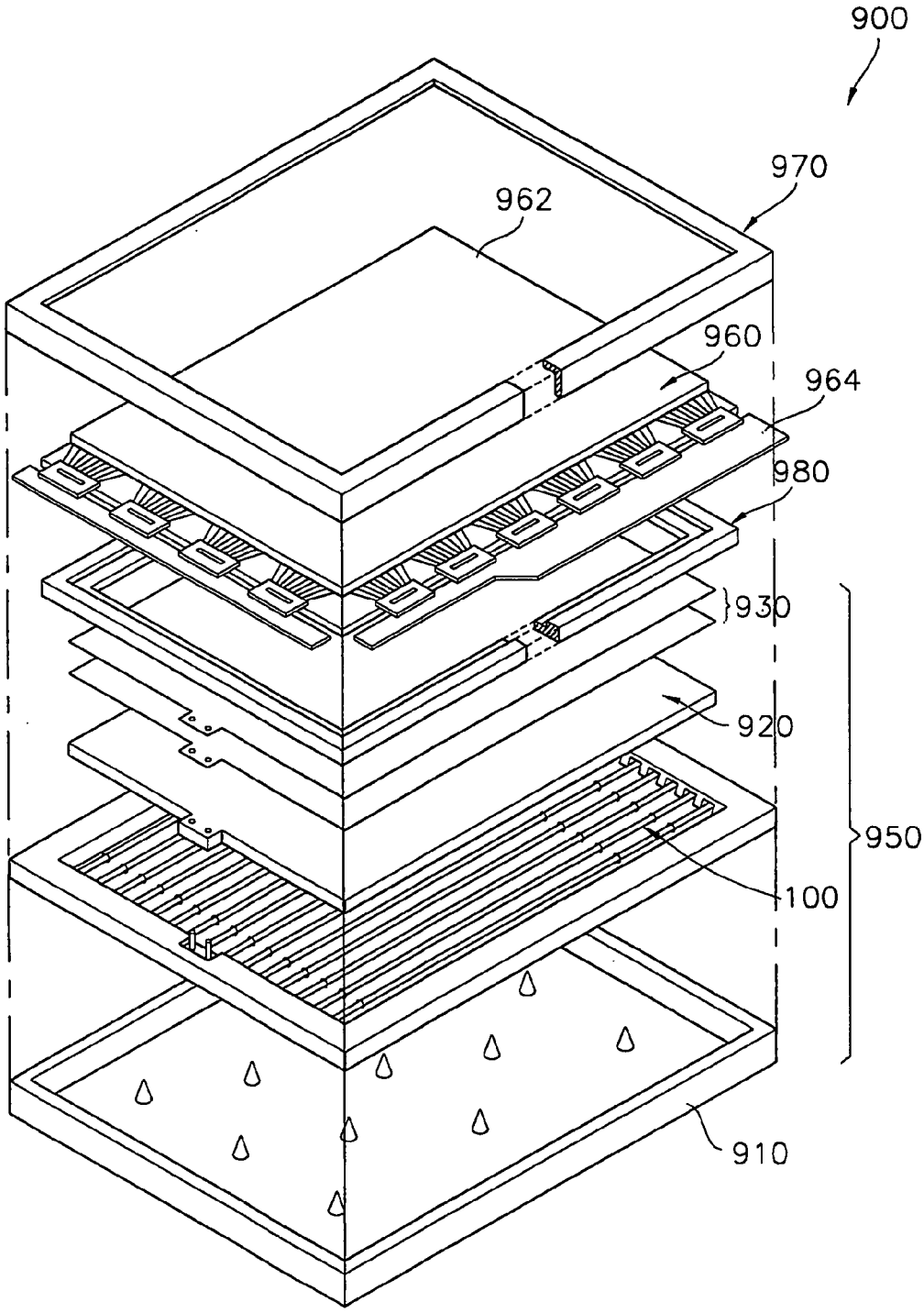
FIG. 11 is an exploded perspective view showing a liquid crystal display device using the lamp according to one embodiment of the present invention.

FIG. 11 shows a liquid crystal display device for displaying an image by using the light generated from the abovementioned lamp.

The liquid crystal display device 900 includes mainly a backlight assembly 950 and a liquid crystal display panel assembly 960. The liquid crystal display device 900 may further include a backlight assembly 950, an intermediate receiving container 980, and a top chassis 970.

Specifically, the liquid crystal display panel assembly 960 includes a liquid crystal display panel 962 and a driving device 964.

The liquid crystal display panel assembly 960 controls locally the light transmissivity by controlling the liquid crystal in minute area unit. In other words, it means that the liquid crystal display panel assembly 960 cannot perform a display function without the light. For this reason, the liquid crystal display device 900 requires light for performing the display function.

Also, a light with a nonuniform brightness cannot be used in displaying devices. A screen looks like a divided screen, one part of the screen looks excessively dark, and another part of the screen looks excessively bright.

Accordingly, a light with a uniform brightness should be used in the liquid crystal display device 900.

The backlight assembly 950, which generates light and makes the brightness of light uniform, is used in the liquid crystal display device 900 according to the present invention.

The backlight assembly 950 includes a receiving container 910, the lamp illustrated enough in Embodiments 1 to 4, a power supply for lamp, and a light uniformity enhancing modules 920 and 930.

The light uniformity enhancing modules 920 and 930 are a diffusion plate 920 and an optical sheet 930.

A white light with a very uniform brightness distribution is generated from the back light assembly 950. The white light generated from the back light assembly 950 is supplied to the liquid crystal display panel assembly 960. The backlight assembly 950 is assembled with the liquid crystal display panel assembly 960 via the intermediate receiver 980.

Then, the top chassis 970 is assembled with the liquid crystal display panel assembly 960 to protect the liquid crystal display panel assembly, thereby the liquid crystal display device being accomplished.

Although, in this invention, the ITO or IZO is used as electrode material formed at the outer surface of the lamp as a preferred embodiment, gold (Au), silver (Ag), copper (Cu), and Nickel (Ni), etc. can be used as electrode material.

As described above, according to the present invention, the method for forming electrodes in the lamp is improved, the light utilization efficiency is maximized, and solves the problem of the nonuniform brightness generating when a plurality of lamps is parallel connected to a power supply.

While the present invention has been described in detail with reference to the preferred embodiments thereof, it should be understood to those skilled in the art that various changes, substitutions and alterations can be made hereto without departing from the scope of the invention as defined by the appended claims.

The invention claimed is:

1. A lamp comprising:

a lamp tube, having a first region and a second region separated from the first region, and including an operation gas and a fluorescent material therein, for generating a light;

a first electrode formed at the first region of the lamp tube; and a second electrode surrounding the circumference of the second region of the lamp tube, being extended toward a center of the lamp tube, and being separated from the first electrode, wherein a cross-sectional diameter of the second electrode progressively decreases as the second electrode extends from a terminal end of the second region of the lamp tube toward the center of the lamp tube.

2. The lamp as claimed in claim 1, wherein the first electrode is disposed in the lamp tube.

3. The lamp as claimed in claim 1, wherein the first electrode is formed along a circumference of the lamp tube from the first region opposite to the second region of the lamp tube towards the center of the lamp, and a cross-sectional diameter of the first electrode progressively decreases as the first electrode extends from a terminal end of the first region of the lamp tube toward the center of the lamp tube.

4. The lamp as claimed in claim 1, wherein the second electrode comprises a conductive and transparent material.

5. A lamp comprising: a lamp tube, having a first region and a second region, and including an operation gas and a fluorescent material therein, for generating a light; a first electrode formed at the first region of a lamp tube formed;

a second electrode surrounding a circumference of the second region of the lamp tube, being extended toward a center of the lamp tube from a second end portion of the lamp tube, and a distance between each first points on a slanted end of the second electrode and each corresponding second points on a second end portion of the second electrode varying continuously when each first points lies precisely on a straight line with each corresponding second points.

6. The lamp as claimed in claim 5, wherein the first electrode is disposed in the lamp tube.

7. The lamp as claimed in claim 5, wherein the first electrode surrounds a circumference at the first region, and is extended toward a center of the lamp tube from a first end portion of the lamp tube, and a distance between each third points on a slanted end of the first electrode and each corresponding fourth points on a first end portion of the first electrode varies continuously when each first points lies precisely on a straight line with each corresponding second points.

8. A method of manufacturing a lamp, the lamp generating a light by an electrical power to a first region and a second region separated from the first region 20 of a lamp tube, said method comprising the steps of: forming a first electrode at the first region of the lamp tube; transferring the lamp tube so that the second region is dipped in a solution for forming all electrode, and forming a second electrode which is coated thicker in proportion to a period during which the second region is dipped in the solution for forming an electrode by pulling out the second region toward the surface of the solution with a gradually decreasing speed.

9. A method of manufacturing a lamp as claimed in claim 8, wherein the step of forming a first electrode further comprises the steps of: transferring the lamp tube so that the first region is dipped in a solution for forming an electrode; and forming a first electrode which is coated thicker in thickness in proportion to the period during which the first region is dipped in the solution for forming an electrode by pulling out the first region toward the surface of the solution with a gradually decreasing speed.

10. A method of manufacturing a lamp as claimed in claim 8, wherein the solution for forming an electrode is an ITO liquid or an IZO liquid.

11. A method of manufacturing a lamp, the lamp generating a light by supplying an electrical power to a first region and a second region separated from the first region of a lamp tube, said method comprising the steps of: forming a first electrode at the first region of the lamp tube; dipping the second region into a solution for forming an electrode so that an angle between the longitudinal axis of the lamp tube and the surface of the transparent solution is an acute angle; and forming a second electrode by pulling out the second region toward the surface of the solution.

12. A method of manufacturing a lamp as claimed in claim 11, wherein the step of forming the first electrode further comprises the steps of: dipping the first region into the solution so that an angle between the longitudinal axis of the lamp tube and the surface of the transparent solution is an acute angle; and pulling out the first region toward the surface of the solution.

13. A method of manufacturing a lamp as claimed in claim 11, wherein the first electrode is disposed in the lamp tube.

14. A method of manufacturing a lamp, the lamp generating a light by an electrical power to a first region and a second region separated from the first region of a lamp tube, said method comprising the steps of: forming a first electrode at the first region of the lamp tube; dipping the second region into a transparent solution for forming an electrode so that an angle between the longitudinal axis of the lamp tube and the surface of the transparent solution is an acute angle; and forming a second electrode by pulling up the second region from the surface of the transparent solution with a gradually decreasing speed.

15. A method for manufacturing a lamp as claimed in claim 14, wherein the first electrode is disposed in the lamp tube.

16. A method for manufacturing a lamp as claimed in claim 14, wherein the transparent solution for forming an electrode is an ITO liquid or an IZO liquid.

* * * * *